US005499748A

United States Patent [19]

Iaia et al.

[11] Patent Number: 5,499,748

[45] Date of Patent: Mar. 19, 1996

[54] CLEANING PRODUCT AND RELATED PACKAGING

[75] Inventors: Mark Iaia, West Nyack, N.Y.; Mark Dziersk, Chicago, Ill.; Javier Verdura, Jr., Canton, Conn.

[73] Assignee: Chesebrough-Pond's USA Co., Division of Conopco, Inc., Greenwich, Conn.

[21] Appl. No.: 283,375

[22] Filed: Aug. 1, 1994

[51] Int. Cl.[6] ..... B67D 5/06

[52] U.S. Cl. ..... 222/180; 222/181.2; 222/213; 248/205.5

[58] Field of Search ..... 222/180, 181.1–181.3, 222/185–185.1, 173, 96, 212, 213, 491, 494; 248/205.5, 206.2, 209, 683

[56] References Cited

U.S. PATENT DOCUMENTS

| | | | |
|---|---|---|---|
| 2,245,703 | 6/1941 | Mueller | 222/181.2 X |
| 2,547,744 | 4/1951 | Burger | 222/181.2 X |
| 3,224,644 | 12/1965 | Davis | 222/180 |
| 3,636,862 | 1/1972 | Bottas et al. | 222/180 X |
| 4,728,006 | 3/1988 | Drobish et al. | 222/181 |
| 4,749,104 | 6/1988 | Chao | 222/181.2 X |
| 4,793,517 | 12/1988 | Washut | 222/180 |
| 5,147,574 | 9/1992 | MacGilp et al. | 252/108 |

*Primary Examiner*—Andres Kashnikow
*Assistant Examiner*—Lisa Douglas
*Attorney, Agent, or Firm*—Milton L. Honig

[57] ABSTRACT

A cleaning product and system is described that includes a fluid cleaning composition, a dispenser for holding the composition and a wall mount that receives and supports the dispenser. An engagement mechanism, such as a curved recess in respective parallel side walls of the dispenser, functions to support same within a U-shaped bracket of the wall mount. The bracket includes left and right arms parallel to one another projecting outwardly and form-fittingly coupling with the recesses on the dispenser side walls. A suction cup is joined to a rear surface of the bracket functioning to attach the wall mount to a wall.

23 Claims, 2 Drawing Sheets

CLEANING PRODUCT AND RELATED PACKAGING

BACKGROUND OF THE INVENTION

1. Field of the Invention

The invention concerns a cleaning product including a cleaning composition held in a dispenser supportable on a wall mount. More particularly, the invention relates to bottom delivery packages for storing and dispensing viscous fluid materials such as shampoos, conditioners, soaps and detergents.

2. The Related Art

Bottom delivery packages having self-sealing valves for storing and dispensing fluid materials such as shampoos, conditioners, soaps or detergents are generally known in the art. The use of a self-sealing valve eliminates the need to operate a removable closure when dispensing the product. Typically the self-sealing valve has a closed position for preventing any discharge of fluid through the valve when not in use, and an open position to dispense fluid through the valve upon the application of manual squeezing forces.

Many bottom delivery packages of the known art do not include a means to hang the package from a support. The package must therefore be picked up and placed down every time it is used. This is inconvenient for the consumer. Some products do include hangers or apertures near top areas of the package to engage a shower head, wall handle or other support.

U.S. Pat. No. 4,728,006 (Drobish et al.) exemplifies a bottom delivery package having a self-sealing valve that can be hung from a hook, shower head or other support. The package disclosed in Drobish has a recessed notch or a hook integral with the package so as to suspend the package on a shower head in an inverted position.

There are disadvantages in having a hook or hanging appendage. For instance, the support on the wall for hanging the hook is not always at a convenient location. Mobility of the dispensing package may also be impaired by the hook mechanism; the hook may render difficult separation of the package from its hanging support. Still another problem, especially with rigid hooks, is that they substantially increase the volume of space needed to ship the package and also disadvantageously increase the amount of shelf space needed for display.

Accordingly, it is an object of the present invention to provide a cleaning product and packaging system whereby hooks and other hanging devices no longer need to be integrally attached to a dispensing package.

Another object of the present invention is to provide a cleaning product and packaging system which permits attachment to areas more convenient than fixtures or other wall protrusions.

Still another object of the present invention is to provide a cleaning product and packaging system which reduces the volume of space needed to ship the product as well as reducing the amount of shelf space needed to display it.

These and other objects of the present invention will become more apparent upon consideration of the subsequent summary and detailed description.

SUMMARY OF THE INVENTION

A cleaning product is provided that includes:

(i) a fluid cleaning composition;

(ii) a dispenser for holding the cleaning composition including;

a front wall, a rear wall, a closed end wall, a dispensing end wall opposite the closed end wall and a pair of side walls in combination defining a container;

a dispensing opening formed in the dispensing end wall of the container; and an engagement element for supporting the container, the engagement element being unitarily formed as identical structures on each of the side walls at a position along a length thereof closer to the closed end wall than the dispensing end wall; and (iii) a wall mount for receiving and holding the container including:

a U-shaped bracket including:

a back plate with front and rear surfaces;

left and right arms parallel to one another, each projecting perpendicularly from the front surface of the back plate and structured to form-fittingly couple with the engagement element; and a suction cup joined to the rear surface of the back plate for attaching the wall mount to a wall.

In a preferred embodiment the bracket further includes a retaining tab on each of the arms, projecting perpendicularly outward from the respective arm. These retaining tabs are oriented toward one another. Preferably the retaining tab is positioned at an end of the arm distant from the back plate. The retaining tabs are perpendicularly arranged so as to hold the dispenser in position thereby preventing its falling out of the wall mount.

According to the preferred embodiment, at least a major portion of each of the arms is contoured to present an elongated convex surface. These convex surfaces are facingly juxtaposed to one another. Alternate equivalent embodiments include a concave surface replacing the convex one which form-fittingly would engage a complementary bulge along the pair of side walls to serve as the engagement element coupling the dispenser to the wall mount.

A support chin is advantageously provided on the back plate of the wall mount projecting outward from the front surface near a lower edge thereof.

According to the present invention, a rear support may be provided which projects perpendicularly outward from the rear surface of the back plate. This rear support is preferably a curved ridge oriented along a lower edge of the back plate. The ridge circumferentially traces an arc along a lower section of the suction cup.

For ease of manufacturing, all the aforementioned elements, except for the suction cup, are unitarily molded and are of a single unitary construction.

BRIEF DESCRIPTION OF THE DRAWING

The above features, advantages and objects of the present invention will more fully be understood by consideration of the drawing describing an embodiment thereof in which.

DETAILED DESCRIPTION

Figure 1:
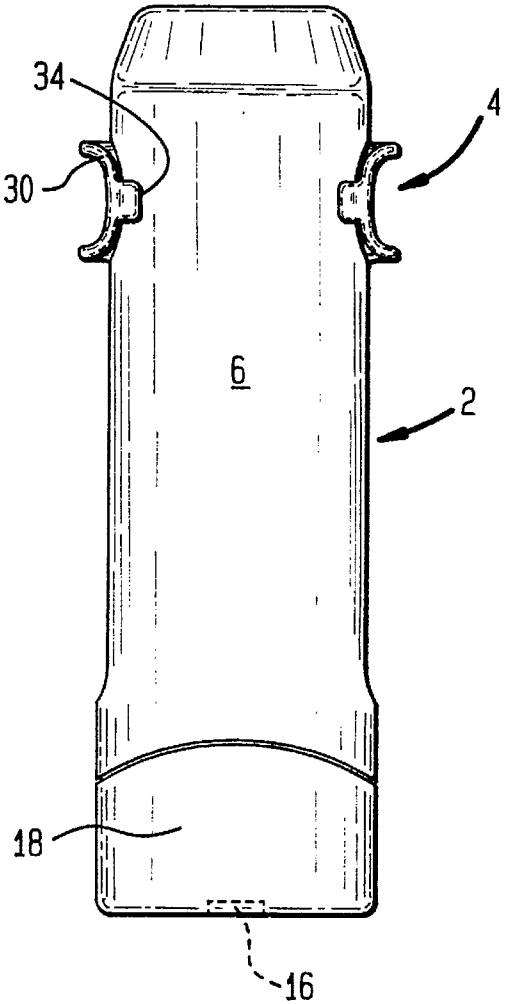
FIG. 1 is a front elevational view of the dispenser held by the wall mount.

A cleaning product of the present invention will include a fluid cleaning composition, a dispenser 2 and a wall mount 4. FIG. 1 best illustrates the packaging system.

Figure 2:
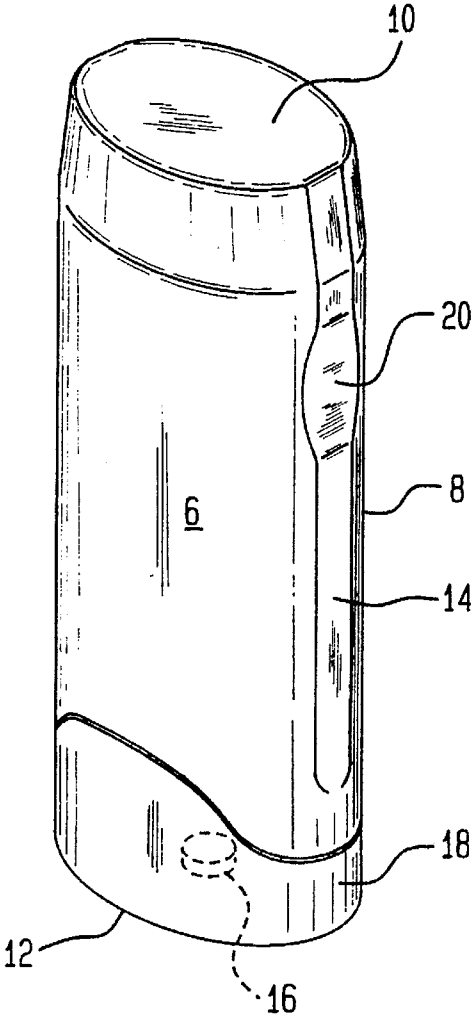
FIG. 2 is a perspective view of the dispenser.

As best seen from FIG. 2, the dispenser 2 includes a front wall 6, a rear wall 8, a closed end wall 10, a dispensing end wall 12 opposite the closed end wall 10, and a pair of side walls 14. Dispenser 2 delivers a liquid or semi-liquid (e.g. gel) cleaning composition via bottom delivery through a dispensing opening 16 (with appropriate valve) in cap 18.

Along each of the side walls 14, unitarily formed thereinto, is a recess 20. This recess is generally concave and positioned more distant from the dispensing end wall 12 than from the closed end wall 10.

Figure 3:
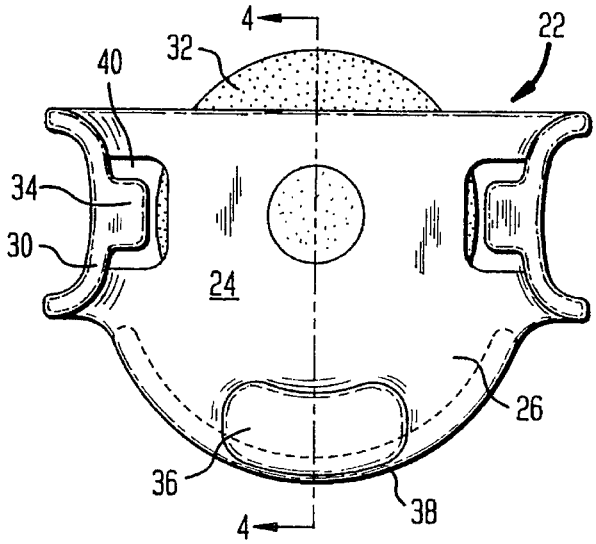
FIG. 3 is a front elevational view of the wall mount.
Figure 4:
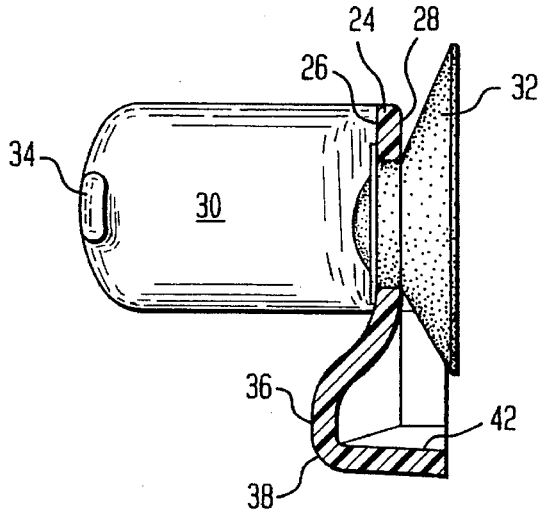
FIG. 4 is a cross-sectional view taken along line 4—4 of FIG. 3.
Figure 5:
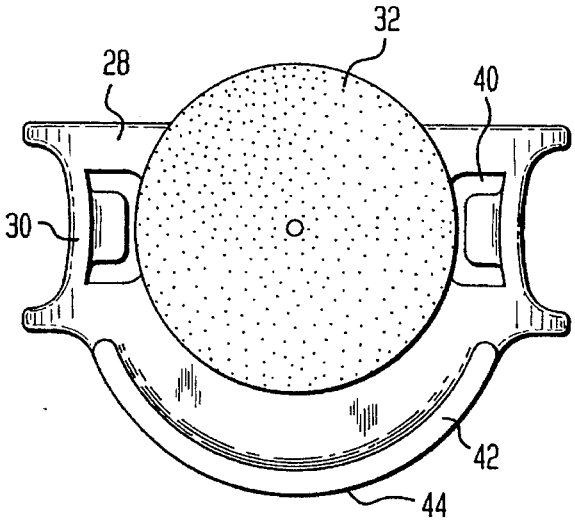
FIG. 5 is a rear elevational view of the wall mount.

FIGS. 3–5 illustrate the wall mount 4 which functions to receive and hold the dispenser. Wall mount 4 includes a U-shaped bracket 22. The bracket is constituted of a back plate 24 with front and rear surfaces 26, 28 respectively, left and right arms 30 and a suction cup 32. Left and right arms 30 parallel one another, each projecting perpendicularly from the front surface 26 of the back plate 24 and are structured to form-fittingly couple with recess 20. Suction cup 32 is joined to the rear surface 28 of the back plate 24. The suction cup functions to attach the wall mount to a wall.

Another aspect of bracket 22 are retaining tabs 34 on each of the arms projecting perpendicularly away from their respective arm and are oriented toward one another. A support chin 36 is present to stabilize the dispenser when held within the bracket. Support chin 36 protrudes outwardly from the back plate 24 from its front surface 26 near a lower edge 38 thereof.

At least a major portion of each of the arms 30 is contoured to present an elongated convex surface. The convex surfaces from each of the arms are facingly juxtaposed to one another.

A pair of windows 40 are formed in back plate 24. Each of these windows 40 sit astride a respective one of the arms 30. These windows function as manufacturing aids in the molding process that produces wall mount 4. In this connection, all pads of the wall mount, except for the suction cup are unitarily molded to achieve a unitary construction.

A rear support 42 projects perpendicularly outward from the rear surface 28 of the back plate 24. FIG. 5 best illustrates this feature. In the preferred embodiment, the rear support 42 is a curved ridge oriented along a lower edge 44 of the rear surface of the back plate.

Fluid cleaning compositions of the present invention are intended to be formulations mainly for use as shampoos, conditioners, soaps and detergents. These compositions generally will contain from 0.1 to 60% of a surfactant. Typical surfactants may be selected from the group consisting of anionic, nonionic, cationic, amphoteric and mixtures of these surfactants. Water in amounts ranging from 1 to 99% by weight usually is also present in the compositions.

Illustrative of shower gels are compositions comprising 10∫70% water, 1–30% surfactant (e.g. cocoyl isethionate, cocoamidobetaine and sodium lauryl sulfate mixtures), 0.1–10% humectant (e.g. glycerin), 0.1–10% silicone oils (e.g. cyclomethicone and dimethicone), and minor amounts of adjuncts such as preservatives (e.g. butylated hydroxytoluene and Glydant), fragrance, pearescent agents (e.g. titanium dioxide coated mica), deodorants (e.g. trichlosan), conditioners (e.g. cationic guar gum) and viscosity modifying inorganic salts.

The foregoing description illustrates only selected embodiments of the present invention, variations and modifications all being within the spirit and purview of this invention.

What is claimed is:

1. A cleaning product comprising:

(i) a fluid cleaning composition;

(ii) a dispenser for holding said cleaning composition comprising:

a front wall, a rear wall, a closed end wall, a dispensing end wall opposite the closed end wall and a pair of side walls in combination defining a container;

a dispensing opening formed in said dispensing end wall of said container; and an engagement means for supporting said container, said engagement means being unitarily formed as identical structures on each of said side walls at a position along a length thereof closer to said closed end wall than to said dispensing end wall; and (iii) a wall mount for receiving and holding said container comprising:

a U-shaped bracket comprising:

a back plate with front and rear surfaces;

left and right arms parallel to one another, each projecting perpendicularly from said front surface of said back plate and structured to form-fittingly couple with said engagement means; and a retaining tab on each of said arms projecting perpendicularly away from said respective arms and one of said retaining tabs oriented toward said other retaining tab; and a suction cup joined to said rear surface of said back plate for attaching said wall mount to a wall.

2. A product according to claim 1 wherein said engagement means is a recess fashioned into said side wall.

3. A product according to claim 1 wherein said retaining tab is positioned at an end of said arm distant from said back plate.

4. A product according to claim 1 wherein said back plate of said wall mount on said front surface near a lower edge thereof includes a support chin protruding outwardly therefrom.

5. A product according to claim 1 wherein at least a major portion of each of said arms is contoured to present an elongated convex surface.

6. A product according to claim 5 wherein said major portions of said arms each are facingly juxtaposed one to another.

7. A product according to claim 1 further comprising a rear support projecting perpendicularly outward from said rear surface of said back plate.

8. A product according to claim 7 wherein said rear support is a curved ridge oriented along a lower edge of said back plate.

9. A product according to claim 1 wherein all of said wall mount, except for said suction cup, is unitarily constructed.

10. A product according to claim 1 wherein said fluid cleaning composition comprises from 0.1 to 60% of a surfactant.

11. A dispensing system comprising:

(i) a dispenser for holding a cleaning composition comprising:

a front wall, a rear wall, a closed end wall, a dispensing end wall opposite the closed end wall and a pair of side walls in combination defining a container;

a dispensing opening formed in said dispensing end wall of said container; and an engagement means for supporting said container, said engagement means being unitarily formed as identical structures on each of said side walls at a position along a length thereof closer to said closed end wall than to said dispensing end wall; and (ii) a wall mount for receiving and holding said container comprising:

a U-shaped bracket comprising:

a back plate with front and rear surfaces;

left and right arms parallel to one another, each projecting perpendicularly from said front surface of said back plate and structured to form-fittingly couple with said engagement means;

a retaining tab on each of said arms projecting perpendicularly away from said respective arms and one of said retaining tabs oriented toward said other retaining tab; and a suction cup joined to said rear surface of said back plate for attaching said wall mount to a wall.

12. A system according to claim 11 wherein said engagement means is a recess fashioned into said side wall.

13. A system according to claim 11 wherein said retaining tab is positioned at an end of said arm distant from said back plate.

14. A system according to claim 11 wherein said back plate of said wall mount on said front surface near a lower edge thereof includes a support chin protruding outwardly therefrom.

15. A system according to claim 11 wherein at least a major portion of each of said arms is contoured to present an elongated convex surface.

16. A system according to claim 15 wherein said major portions of said arms each are facingly juxtaposed one to another.

17. A system according to claim 11 further comprising a rear support projecting perpendicularly outward from said rear surface of said back plate.

18. A system according to claim 17 wherein said rear support is a curved ridge oriented along a lower edge of said back plate.

19. A system according to claim 11 wherein all of said wall mount, except for said suction cup, is unitarily constructed.

20. A cleaning product comprising:

(i) a fluid cleaning composition;

(ii) a dispenser for holding said cleaning composition comprising:

a front wall, a rear wall, a closed end wall, a dispensing end wall opposite the closed end wall and a pair of side walls in combination defining a container;

a dispensing opening formed in said dispensing end wall of said container; and an engagement means for supporting said container, said engagement means being unitarily formed as identical structures on each of said side walls at a position along a length thereof closer to said closed end wall than to said dispensing end wall; and (iii) a wall mount for receiving and holding said container comprising:

a U-shaped bracket comprising:

a back plate with front and rear surfaces, said back plate on said front surface near a lower edge thereof including a support chin protruding outwardly therefrom;

left and right arms parallel to one another, each projecting perpendicularly from said front surface of said back plate and structured to form-fittingly couple with said engagement means; and a suction cup joined to said rear surface of said back plate for attaching said wall mount to a wall.

21. A cleaning product comprising:

(i) a fluid cleaning composition;

(ii) a dispenser for holding said cleaning composition comprising:

a front wall, a rear wall, a closed end wall, a dispensing end wall opposite the closed end wall and a pair of side walls in combination defining a container;

a dispensing opening formed in said dispensing end wall of said container; and an engagement means for supporting said container, said engagement means being unitarily formed as identical structures on each of said side walls at a position along a length thereof closer to said closed end wall than to said dispensing end wall; and (iii) a wall mount for receiving and holding said container comprising:

a U-shaped bracket comprising:

a back plate with front and rear surfaces;

left and right arms parallel to one another, each projecting perpendicularly from said front surface of said back plate and structured to form-fittingly couple with said engagement means; and a rear support projecting perpendicularly outward from said rear surface of said back plate; and a suction cup joined to said rear surface of said back plate for attaching said wall mount to a wall.

22. A dispensing system comprising:

(i) a dispenser for holding a cleaning composition comprising:

a front wall, a rear wall, a closed end wall, a dispensing end wall opposite the closed end wall and a pair of side walls in combination defining a container;

a dispensing opening formed in said dispensing end wall of said container; and an engagement means for supporting said container, said engagement means being unitarily formed as identical structures on each of said side walls at a position along a length thereof closer to said closed end wall than to said dispensing end wall; and (ii) a wall mount for receiving and holding said container comprising:

a U-shaped bracket comprising:

a back plate with front and rear surfaces, said back plate on said front side near a lower edge thereof including a support chin protruding outwardly therefrom; and left and right arms parallel to one another, each projecting perpendicularly from said front surface of said back plate and structured to form-fittingly couple with said engagement means; and a suction cup joined to said rear surface of said back plate for attaching said wall mount to a wall.

23. A dispensing system comprising:

(i) a dispenser for holding a cleaning composition comprising:

a front wall, a rear wall, a closed end wall, a dispensing end wall opposite the closed end wall and a pair of side walls in combination defining a container;

a dispensing opening formed in said dispensing end wall of said container; and an engagement means for supporting said container, said engagement means being unitarily formed as identical structures on each of said side walls at a position along a length thereof closer to said closed end wall than to said dispensing end wall; and (ii) a wall mount for receiving and holding said container comprising:

a U-shaped bracket comprising:

a back plate with front and rear surfaces;

left and right arms parallel to one another, each projecting perpendicularly from said front surface of said back plate and structured to form-fittingly couple with said engagement means; and a rear support projecting perpendicularly outward from said rear surface of said back plate; and a suction cup joined to said rear surface of said back plate for attaching said wall mount to a wall.

* * * * *